US005368894A

United States Patent [19]

Lammers et al.

[11] Patent Number: 5,368,894

[45] Date of Patent: Nov. 29, 1994

[54] METHOD FOR PRODUCING A MULTILAYERED ELEMENT HAVING A TOP COAT

[75] Inventors: Ted J. Lammers, Vadnais Heights; Norman Newman, Mendota Heights; Karen M. Romaszewski, Apple Valley; David J. Scanlan, Fairport, all of Minn.; Alfredo Fenoglio, Savona, Italy

[73] Assignee: Minnesota Mining and Manufacturing Company, St. Paul, Minn.

[21] Appl. No.: 242,683

[22] Filed: May 19, 1994

Related U.S. Application Data

[63] Continuation-in-part of Ser. No. 74,067, Jun. 8, 1993.

[51] Int. Cl.[5] ..... B05D 1/36

[52] U.S. Cl. ..... 427/407.1; 427/202; 427/336; 427/411; 427/412.5; 427/419.1; 427/419.7; 427/419.2; 427/414

[58] Field of Search ..... 427/414, 336, 338, 202, 427/404, 419.1, 419.7, 419.8, 412.5, 411, 419.2

[56] References Cited

U.S. PATENT DOCUMENTS

| | | | |
|---|---|---|---|
| 3,507,682 | 4/1970 | Flavin et al. . | |
| 3,987,221 | 10/1976 | Baldock | 427/338 |
| 4,001,024 | 1/1977 | Dittman et al. | 96/87 |
| 4,092,173 | 5/1978 | Novak et al. | 96/116 |
| 4,119,464 | 10/1978 | Sauerteig et al. | 427/338 |
| 4,196,001 | 4/1980 | Joseph et al. | 427/202 |
| 4,218,533 | 8/1980 | Fuchigami et al. | 430/512 |
| 4,219,220 | 8/1980 | Oda et al. | 427/204 |
| 4,298,673 | 11/1981 | Kubotera et al. | 430/204 |
| 4,361,635 | 11/1982 | Kinderman et al. | 430/14 |
| 4,647,528 | 3/1987 | Yamada et al. | 430/567 |
| 4,655,787 | 4/1987 | Renton | 427/336 |
| 4,791,881 | 12/1988 | Iwasaki | 118/244 |
| 4,960,687 | 10/1990 | Cho | 427/302 |
| 4,977,065 | 12/1990 | Westfal et al. | 427/414 |
| 5,034,249 | 7/1991 | Reif et al. | 427/338 |
| 5,248,522 | 9/1993 | Araki et al. | 427/316 |
| 5,310,637 | 5/1994 | Kurz et al. | 427/414 |
| 5,314,713 | 5/1994 | Mori et al. | 427/336 |
| 5,316,902 | 5/1994 | Specht et al. | 427/338 |

FOREIGN PATENT DOCUMENTS

WO92/15921 9/1992 WIPO .

*Primary Examiner*—Shrive Beck
*Assistant Examiner*—Diana Dudash
*Attorney, Agent, or Firm*—Gary L. Griswold; Walter N. Kirn; Thomas C. Lagaly

[57] ABSTRACT

A method is provided for producing a multilayered element having a top coat. The method includes the application of an undercoating to the upper surface of a support and the application of a continuous top coat coating composition to the surface of the undercoating. The undercoating includes a binder while the top coat composition includes one or more dissolved or dispersed materials and one or more solvents. At least one of the solvents is compatible with the binder. The composition and coating weight of the top coat composition and of the undercoating are controlled such that the ratio T/B is less than or equal to 3, wherein T is the coating weight of the compatible solvent(s), and B is the coating weight of the binder.

25 Claims, 1 Drawing Sheet

METHOD FOR PRODUCING A MULTILAYERED ELEMENT HAVING A TOP COAT

This is a continuation-in-part of copending application U.S. Ser. No. 08/074,067 filed Jun. 8, 1993.

BACKGROUND OF THE INVENTION

The present invention relates to a method for producing a film, sheet, or other element having a top coat. More particularly, it relates to a method for applying a top coat which provides a functional property to an element by virtue of the top coat being on the uppermost surface of the film.

Photographic materials, as well as many other types of film or sheet construction, have become increasingly sophisticated and require certain functional properties in addition to their basic photosensitivity to properly serve the users needs. A particular class of desirable functional properties are those which exist by virtue of a top coat which resides on the uppermost surface of a film or sheet such as a photographic element. The top coat results from a coating composition which is applied to the surface of the element to become the uppermost surface thereof. For example, in a photographic element, the top coat is often applied to the photosensitive layer of the photographic element.

The top coat coating composition generally includes dissolved or dispersed materials and a solvent. After being applied to the uppermost surface of the photographic element, the coating composition is dried so that essentially only the dissolved or dispersed materials, and sometimes a binder, remain. It is those remaining materials which impart the desired functional property to the photographic element. However, functionality will result only if some effective amount of the materials (hereinafter referred to as "surface functional materials") remain on the uppermost surface of the photographic element after the coating composition has been dried.

Top coats comprising surface functional materials are quite common. Examples include diffusion transfer top coats which contain nucleating particles (used, e.g., to form direct acting printing plates); matte surface top coats containing matte agents (used in graphic arts materials to allow vacuum drawdown for intimate contact between films); and antistatic top coats containing conductive materials.

In the case of diffusion transfer top coats, direct acting printing plates are produced by the formation of an oleophilic silver layer, generated by a diffusion transfer process, on the uppermost surface of the printing plate after exposure and development. See, e.g., U.S. Pat. No. 4,361,635. Nucleating particles, composed of palladium specks or other materials as described in U.S. Pat. No. 4,298,673, are required to be on the uppermost surface of the diffusion transfer element to serve as sites for the formation of the oleophilic silver layer during development. If these particles are not physically present on the surface, they cannot serve as centers for silver development on the uppermost surface of the printing plate. As a result, an oleophilic, ink receptive surface will not form on the uppermost surface of the printing plate.

Matte surface top coats are used, for example, in the graphic arts industry. Contact exposures are made to reproduce and modify images that will eventually lead to a printing plate. In the process of making these contact exposures, an imaged film, a photosensitive element, a proofing element, and/or other graphic arts elements need to be drawn into intimate contact in a vacuum device. The intimate contact is required to assure good reproduction without spreading of the image. Image spreading occurs when there is a space, caused by trapped pockets of air, between the imaged film and the other element. Such air pockets are difficult to remove and lead to extended vacuum drawdown times. Additionally, Newton's rings, which are unwanted lines caused by light diffraction due to reflections off of adjacent surfaces, can occur. Both air pockets and Newton's rings are caused by the smooth texture of the imaged film and the other elements. As is known, such problems can be overcome by applying a matte surface top coat to either or both of the imaged film and the other element. When placed into contact with one another, the relatively rough matte surfaces allow the elements to be drawn into intimate contact without air pockets or Newton's rings, thereby permitting the vacuum drawdown to proceed in a reasonable time.

Typical matte surface top coats include matte agents which are particulates composed of silica or polymer having a size ranging from 2 to 10 microns. A coating composition containing the matte agent is typically applied to the uppermost surface of the undercoating (which contains the photosensitive layer of the photosensitive element) so that the matte surface top coat will form the uppermost surface of the photosensitive element. In order to be effective, the matte agent must cause irregularities to form on the uppermost surface of the photosensitive element after the coating composition has been dried.

An added concern with matte surface top coats is a phenomenon known as "starry night." As the photosensitive undercoating and top coat are being dried, the matte particles can be forced into the undercoating by the surface tension forces developed during drying and displace silver halide particles in the undercoating, thereby causing voids to appear in the image. Thus, it is desirable to keep the matte agent on the uppermost surface of the photographic element for this additional reason.

A problem which is common to top coats containing dispersed or dissolved surface-functional materials, such as diffusion transfer top coats or matte surface top coats, is the migration of the surface-functional material into the undercoating. When this occurs, the surface-functional material becomes incapable of, or less effective in, performing its desired function since functionality is dependent upon the physical presence of the material on the uppermost surface of the photographic element. In addition, with matte surface top coats in photographic elements containing silver halide emulsions, such migration can also cause the starry night effect.

The undercoating (i.e. the coating(s) or sublayer(s) located between the top coat and the support for the element and, in the case of photographic elements, containing the photosensitive portion of the element) includes a binder, such as gelatin. Typically, the solvent used in the top coat, e.g., water, is "compatible" with the binder. That is, the solvent is capable of penetrating the binder and causing it to swell. While some swelling is desirable in that it promotes adhesion of the top coat to the undercoating, swelling is also believed to be a leading contributor in the migration of the dispersed or dissolved materials from the top coat and into the binder, thereby causing the surface-dependent top coat to become non-functional since it is no longer on the uppermost surface of the element.

Conventional solutions to this problem include the addition of hardening compounds into the undercoating prior to the application of the top coat thereto. Typical hardening compounds such as, e.g., formaldehyde or mucochloric acid, begin to cross-link upon drying of the undercoating. By cross-linking, hardening compounds have the effect of reducing the degree to which the binder in the undercoating can swell, thereby reducing the migration of the dissolved or dispersed elements from the top coat into the undercoating.

Unfortunately, most hardening compounds cross-link at a rate which is too slow to permit successful in-line application of the top coat composition to the photographic element. Typically, the undercoating containing the binder and hardening compound is applied to a support which is in the form of a continuous web. After the undercoating is applied to the support, the coated support must be wound into a roll, removed from the coating apparatus, and stored for a period of time to allow the hardening compound to cross-link. This wind-up/hardening period must be long enough to permit a sufficient degree of cross-linking by the hardening compound to impart enough swelling resistance to the binder in the undercoating so that the dissolved or dispersed surface-functional materials in the top coat are prevented from migrating into the undercoating. Typically, such a period can range from one hour to one week. In either case, after the hardening period has expired, the photographic element is removed from storage and re-inserted into the coating apparatus so that the top coat can be applied to the hardened undercoating. This two-stage procedure is both time consuming and costly, as well as being highly inconvenient.

An alternative approach to the two-stage procedure described above has been proposed in PCT Publication Number WO 92/15921. That reference provides a method for accelerating the hardening of a photographic coating composition containing a binder and a hardener, where the coating composition has been coated on a continuous web-like support. In addition to a chill section and a drier (which are normally used in such processes), the method employs a tempering zone, a high-temperature heating zone, an afterhardening reaction and incubation zone, a post cooling zone, a moisture content-adjusting zone, and a cooling zone. After the support has been coated and sent through the chill section and drier, the coated support is transported through the various zones in the order listed above. Through precise control of temperature, relative humidity, and air flow, especially in the reaction and incubation zone, the coating is said to be 85% hardened before exiting the coating machine. Moreover, the duration of time in the reaction and incubation zone is said to be less than 10 minutes. The disadvantage of such a method, however, is the capital, maintenance, and operational costs for each of the aforementioned zones.

Accordingly, it is seen that a need exists in the art for a method of producing a multilayered photographic element having an undercoating and surface-functional top coat in which the top coat is applied in the same continuous process stream as the undercoating is applied, and in which the top coat does not migrate into the undercoating to the extent that it is incapable of providing a desired surface-related functional property to the multilayered element.

SUMMARY OF THE INVENTION

The present invention provides a method for applying a top coat to a multilayered element. The top coat is applied tandemly, and yet at least enough of the top coat remains on the surface of the multilayered element that the intended function for which the top coat is applied is present during the use of the multilayered element. Construction of the entire multilayered element of the present invention, including the top coat, can be completed in one pass through the coating apparatus used to apply the undercoating and top coat. No off-line hardening or aging periods for the layer(s) under the top coat are required prior to applying the top coat, thereby resulting in substantial savings of time and money, as well as adding to the convenience and efficiency of the operation.

The present invention provides a method for producing a multilayered element having a top coat, comprising the steps of:

a. providing a support having an upper surface and a lower surface;

b. applying an undercoating to the upper surface, the undercoating including a binder;

c. applying a continuous top coat coating composition to the surface of the undercoating, the top coat composition including one or more dissolved or dispersed materials and one or more solvents, at least one of the solvents being compatible with the binder of the undercoating, the composition and coating weight of the top coat composition and of the undercoating being such that the ratio T/B is less than or equal to 3, wherein T is the coating weight (usually expressed as grams/$m^2$) of the compatible solvent(s) in the top coat, and B is the coating weight (usually expressed as grams/$m^2$) of the binder in the undercoating; and d. drying the top coat composition.

The term "continuous," as used to modify the phrase "top coat coating composition," is herein defined to mean that the top coat composition is coated within substantial (e.g. at least 10 $mm^2$) and unbroken areas on the upper surface of the element; i.e., not applied as droplets or globules. These areas may also be applied as stripes or patterns, rather than the preferred continuous film layer over substantially the entire surface of the element.

As used herein, the term "compatible" is defined to mean that at least one of the solvents in the top coat composition is capable of penetrating the binder and causing it to swell.

As stated, the ratio T/B is less than or equal to 3. More preferably, the ratio is less than or equal to 2. Most preferably, the ratio is less than or equal to 1,125. Within the specified ratio, the top coat composition may be applied at a wet film thickness of 0.5 to 10 microns.

Any type of dissolved or dispersed materials may be included in the top coat. For example, the dissolved or dispersed material may comprise a nucleating agent selected from the group consisting of metals, metal salts, metal oxides, metal sulfides, metal coated particles, metal salt coated particles, metal oxide coated particles, or metal sulfide coated particles. Of this group, palladium or palladium salts are preferred. As another example, the dissolved or dispersed material may comprise a dispersed particulate matte agent.

Any type of solvent or combination of miscible solvents may be used in the top coat. Similarly, any type of binder or combination of binders may be used in the undercoating. So that the top coat will adhere to the undercoating, the solvent (or if multiple solvents are used, at least one of the solvents) must be compatible with the binder in the undercoating.

A preferred binder/solvent combination is gelatin and water. That is, when gelatin is used as the binder in the undercoating, it is preferred that at least one of the solvents in the top coat be water.

Advantageously, the top coat composition may be applied in a tandem process. As used herein, the term "tandem process" is defined to mean an in-line coating station in the same continuous process stream as the coating operation in which the undercoating is applied, but downstream of the point at which the undercoating is applied. In other words, the multilayered element is not pulled off-line to allow the element to sit idle while aging, hardening, or undergoing any other type of reaction, but rather is completely manufactured in one pass through the coating apparatus.

In accordance with the practice of the present invention, a variety of coating devices may be used to tandemly apply the top coat composition. A particularly preferred tandem coating device is a gravure coater, such as a micro-gravure coater as disclosed in U.S. Pat. No. 4,791,881.

When a top coat composition comprising a dissolved material (as opposed to a dispersed material) is applied to a multilayered element in accordance with the method of the present invention, immediately upon drying of the top coat composition, at least a monolayer of the dissolved material remains on the surface of the undercoating. A "monolayer" means a continuous layer of coverage on the surface of the undercoating which is at least one molecule of dissolved material in thickness. Such coverage is approximately the minimum sufficient to impart the functional property of the dissolved material, e.g., an antistatic material, to the multilayered element.

When a top coat composition comprising a dispersed material is applied to a multilayered element in accordance with the method of the present invention, immediately upon drying of the top coat composition, at least one third by weight of the dispersed material remains on the surface of the undercoating. Such amount is usually sufficient to impart functionality to the multilayered element.

DETAILED DESCRIPTION OF THE INVENTION

Figure 1:
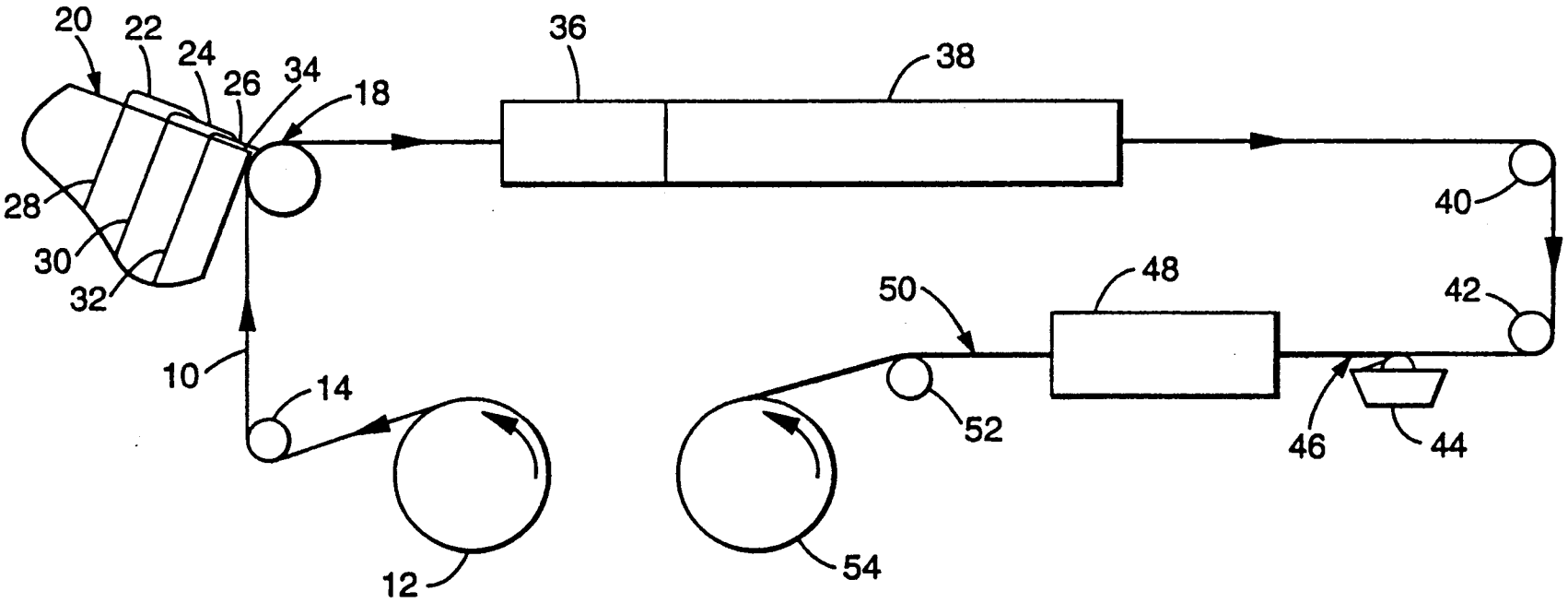
FIG. 1 schematically illustrates a preferred process and coating apparatus for producing the multilayered element of the present invention.

The multilayered element produced in accordance with the method of the present invention may be used in a wide variety of applications. For example, the present method may be used to produce various types of films such as graphic arts film, medical imaging film, color photographic film, and X-ray film, as well as other coated materials such as magnetic media, printing plates, proofing materials, etc. In addition, diffusion transfer plates may be produced which, in turn, are used to form direct acting printing plates. The multilayered element of the present invention may contain radiation sensitive components which react to form images upon exposure to various types of radiation by any type of known reaction mechanism, including, e.g., negative acting systems, direct positive acting systems, and reverse acting systems.

The support onto which the undercoating and top coat are applied can be selected from any of these which are well known in the art. Suitable supports include, but are not limited to, films of synthetic polymers such as polyalkyl acrylate or methacrylate, polystyrene, polyvinyl chloride, polyvinyl alcohol and derivatives thereof, polycarbonate, polyesters such as polyethylene terephthalate, and polyamides; films of cellulose derivatives such as cellulose nitrate, cellulose acetate, cellulose triacetate, and cellulose acetate butyrate; coated paper such as paper covered with, e.g., alpha-olefin polymers or gelatin; synthetic papers made of polystyrene; and any other transparent or opaque support. Particularly desirable are those supports commonly used in photographic elements. When diffusion transfer plates are produced, any type of metal or other material commonly used to produce such plates may be used as a support.

The undercoating which is applied to the upper surface of the support, and upon which the top coat is applied, may include a wide variety of materials. Additionally, the undercoating may be a single layer or may comprise multiple sublayers such as, e.g., one or more photosensitive layers, antihalation or filter layers, protective layers, interlayers, barrier layers, stripping layers, etc.

One or more of the photosensitive layers may include a silver halide emulsion prepared by any of the techniques commonly known in the art. In the case of a diffusion transfer plate, one of the photosensitive layers in the undercoating may include a negative acting silver halide diffusion transfer emulsion. The silver halides which may be used in the multilayer element of the present invention include, but are not limited to, silver chloride, silver bromide, silver chlorobromide, silver iodochlorobromide, silver bromoiodide and silver chloroiodide grains, which may be in any of the many available crystal forms or habits alone or in combination including, but not limited to, cubic, octahedral, tetrahedral, lamellar, tabular, orthorhombic, etc. In addition, the silver halide material may be spectrally sensitized.

Typical undercoatings which are useful in the multilayer element of the present invention include a binder. The binder serves to hold the undercoating together after the undercoating has been applied to the support and dried. Where the undercoating comprises multiple sublayers, different binders may be used in different sublayers. Suitable binders include, but are not limited to, gelatin, gelatin derivatives, graft polymers of gelatin; other polymers such as albumin and casein; sugar derivatives such as cellulose derivatives (e.g., hydroxyethyl cellulose, carboxymethyl cellulose, cellulose sulfate, and cellulose acetate butyrate), sodium alginate, and starch derivatives; and various synthetic hydrophilic polymeric substances, homopolymers or copolymers, such as polyvinyl alcohol, polyvinyl alcohol partial acetal, poly(N-vinyl)pyrrolidone, acrylate derivatives (e.g., polyacrylic acid, poymethacrylic acid, polyacrylamide), polyvinyl imidazole, and polyvinyl pyrazole. For most applications, gelatin is the preferred binder.

The binder may be applied to the multilayered element of the present invention at any desirable or convenient coating weight. For example, when a photosensitive layer is included in the multilayered element, the binder may be applied at a coating weight ranging from about 0.75 to about 6 grams/$m^2$, and preferably at a coating weight ranging from about 1.25 to about 4.5 grams/$m^2$. Most preferably, the coating weight of the binder ranges from about 2 to about 4 grams/$m^2$.

Photographic materials and other image-forming elements encompassed by the present invention are often exposed to various processing solutions after imaging. Thus, it is desirable to treat the binder used in the undercoating in such a manner that it will not swell excessively, nor dissolve, distort or otherwise deteriorate in such processing solutions. Excessive swelling would deleteriously affect the physical characteristics of the element while dissolution or deterioration would result in an unsatisfactory or unusable element. A preferred means of treating the binder to avoid such adverse results is to add one or more hardening compounds to the undercoating. Although, as stated above, hardening compounds generally cross-link at a rate which is too slow to permit in-line application of a top coat composition to a multilayered element, most commercially available hardening compounds do provide sufficient hardening over the life of the element to prevent excessive swelling and/or dissolution upon exposure to processing solutions. Because hardening of the undercoating before application of the top coat is not essential to the present invention, however, there is no need to wait for hardening to occur before applying the top coat.

Any commercially available hardening compound may be included in the undercoating of the present multilayered element. Such compounds include, but are not limited to, inorganic compounds such as chrome alum, aldehydes such as formaldehyde and glutaraldehyde, active halogen-containing compounds, compounds having reactive ethylenically unsaturated groups, aziridine series compounds, epoxy compounds, and halogenocarboxyaldehydes such as mucochloric acid.

In addition to the foregoing, the undercoating may also include protective colloids such as acylated gelatins; cellulose compounds such as hydroxyethyl cellulose and carboxymethyl cellulose; soluble starch such as dextrin; hydrophilic polymers such as polyvinyl alcohol, polyvinyl pyrrolidone, and polyacrylamide; plasticizers for dimensional stabilization; and latex polymers. Where the undercoating comprises multiple sublayers, different protective colloids may be included in different sublayers.

Various other well known addenda may also be included in the undercoating of the present multilayered element, such as, but not limited to spectral sensitizers, stabilizers, antifoggants, surfactants, polymer latices, development agents and/or development promoters, couplers, and acutance or filter dyes. When multiple sublayers are present in the undercoating, different ones of the above addenda may be included in different sublayers.

The undercoating may be applied to the support by standard coating techniques such as slide coating, bar coating, roll coating, knife coating, curtain coating, rotogravure coating, spraying, and dipping. When the undercoating is to include multiple sublayers, the sublayers may be applied simultaneously, such as by a slide coater. See, e.g., U.S. Pat. No. 4,001,024.

After the undercoating has been applied to the support, a continuous coating composition is applied to the uppermost surface of the undercoating in a tandem (i.e. in-line) process. This continuous coating composition (hereinafter referred to as the "top coat composition") will become the top coat of the present multilayer element once it has been dried (i.e. after the solvent has been removed therefrom).

The top coat composition is applied in a continuous manner. The term "continuous" means that the top coat composition is coated within substantial (e.g. at least 10 $mm^2$) and unbroken areas on the upper surface of the multilayer element. That is, the top coat composition is not applied as droplets or globules. The top coat composition may also be applied as stripes or patterns.

The top coat composition includes one or more dissolved or dispersed materials and one or more solvents. The dissolved or dispersed materials are surface functional in that they provide a functional property to the multilayered element by virtue of physically residing on the uppermost surface of the element.

At least one of the solvents is compatible with the binder. The term "compatible" means that at least one of the solvents in the top coat is capable of penetrating the binder and causing it to swell. Compatibility is desirable in that at least a limited amount of swelling promotes adhesion between the top coat and the undercoating. However, excessive swelling undesirably results in excessive migration of the dissolved or dispersed materials into the undercoating, thereby preventing the surface functional materials from performing their intended function.

It has been found that, despite swelling, the dissolved or dispersed materials may be maintained on the uppermost surface of the multilayered element by controlling the ratio of compatible solvent to binder. Such ratio is defined as T/B, wherein:

T is the coating weight of the compatible solvent (or solvents, as the case may be) in the top coat composition, and B is the coating weight of the binder in the undercoating. The coating weights of the compatible solvents and of the binder may conveniently be expressed as grams/$m^2$.

Specifically, it has been determined that if the composition and coating weight of the top coat composition and of the undercoating are controlled such that the ratio T/B is less than or equal to 3, at least enough of the dissolved or dispersed materials in the top coat composition will remain on the surface of the multilayered element after drying that the dissolved or dispersed materials will be capable of providing the multilayered element with at least some degree of the specific functional property which such materials were intended to provide. Moreover, when the dissolved or dispersed materials comprise a dispersed particulate matte agent, a ratio T/B of less than or equal to 3 will result in minimal to no displacement of silver halide particles in the undercoating by the matte agent particulates such that the starry night effect is substantially prevented from occurring.

Although a maximum T/B ratio of 3 has been stated, no minimum ratio exists. That is, the ratio can be made as low as desirable or practicable. Although it is anticipated that ratios will typically be above 0.05, ratios approaching or even reaching zero are possible (as when only incompatible solvent is used in the top coat composition).

A more preferred T/B ratio is one which is less than or equal to 2 and, most preferably, one which is less than or equal to 1.125. In general, the lower that the ratio is, the lesser the degree of swelling of the binder will be and, therefore, the greater will be the number of dissolved or dispersed materials which remain on the surface of the multilayered element after drying. However, as stated, at a ratio of less than equal to 3, at least enough of the dissolved or dispersed materials will remain on the surface of the multilayered element for at least some functionality to be realized.

For example, when the top coat composition is selected to contain a dissolved (as opposed to a dispersed) material, such as an antistatic agent, immediately upon drying of the top coat composition, at least a monolayer of the dissolved material remains on the surface of the undercoating. A "monolayer" refers to a continuous layer of coverage on the surface of the undercoating which is at least one molecule of dissolved material in thickness. As a further example, when the top coat composition is selected to contain a dispersed material, such as a nucleating agent or matte agent, immediately upon drying of the top coat composition, at least one third by weight of the dispersed material remains on the surface of the undercoating. In both cases, the amount of material remaining on the surface is sufficient to impart functionality to the multilayered element.

As stated, the solvent in the top coat composition is compatible with the binder. In some instances, more than one solvent may be used in the top coat composition, e.g., water and methanol. In those cases, at least one of the solvents is selected to be compatible with the binder. When gelatin, the preferred binder for photographic materials, is used in the undercoating, it is preferred that at least one of the solvents in the top coat composition be water. Water is compatible with gelatin, is relatively inexpensive, and poses no environmental concerns. Other binders with which water is compatible include polyvinyl alcohol and carboxymethyl cellulose derivatives.

If one of the binders in the undercoating is cellulose acetate butyrate or an acrylate derivative such as polyacrylic acid, poymethacrylic acid, or polyacrylamide, compatible solvents which may be selected for use in the top coat composition include ethyl acetate, an alcohol, or a ketone.

Any desired type of dissolved or dispersed material may be included in the top coat composition, depending upon the surface-related functional property it is desired to impart on the multilayered element. One example of a dispersed material which may be included in the top coat composition is a nucleating agent. When dried, this top coat composition will result in a diffusion transfer top coat, and thus the multilayered element containing the top coat may be used to produce a direct acting printing plate. The nucleating agent is preferably selected from the group consisting of metals, metal salts, metal oxides, metal sulfides, metal coated particles, metal salt coated particles, metal oxide coated particles, or metal sulfide coated particles. Of this group, palladium or palladium salts are preferred. However, the practice of the present invention is not limited to any particular nucleating agent. Examples of commonly known nucleating agents which may also be used include colloidal silver, silver sulfide, nickel sulfide, zinc sulfide, sodium sulfide, colloidal sulfur, stannous chloride, chloroauric acid, and the like.

The preferred solvent in a diffusion transfer top coat composition is water. Other solvents which may be used include alcohols such as methanol or ethanol, and ketones such as acetone. The top coat composition may further include starch and a nonionic or anionic surfactant, such as, e.g., those disclosed in U.S. Pat. No. 4,361,635.

The preferred binder in the undercoating of a diffusion transfer element prepared in accordance with the method of the present invention is gelatin.

Another example of a dispersed material which may be included in the top coat composition of the present invention is a matte agent. Any type of matte agent may be used including, without limitation, starch, titanium dioxide, zinc oxide, silica, and polymeric beads such as beads of polymethyl methacrylate and the like. The top coat composition may also contain gelatin. The preferred solvent to be used in the top coat composition is water. The preferred binder in the undercoating is gelatin.

An example of a dissolved material which may be included in the top coat composition is an antistatic material. This top coat composition preferably includes a surfactant with water as the preferred solvent. Examples of suitable surfactants include polyethylene oxides such as nonylphenoxy polyethylene oxide, alkyl-aryl polyoxyethylenes, and alkyl-aryl-polyglycidols.

Other materials which may be used as an antistatic material include lubricants such as polydimethyl-siloxanes which reduce charge build up by reducing friction between adjacent sheets.

The practice of the present invention may also be applied to the production of magnetic recording media, such as multiple layer magnetic tapes, disks, and the like. Multiple layer magnetic recording media generally include an undercoating coated on a support, and a top coat applied to the undercoating. Suitable supports for such magnetic media include, for example, polyethylene terephthalate, polyethylene napthalate, and polyimides. One or more binders are typically included in the undercoating. Examples of binders which may be used in the undercoating include polyurethanes which may have vinyl and/or isocyanate groups, and which may be combined with bisphenol A. Other constituents may also be included in the undercoating, such as alpha iron oxide, carbon black, titanium dioxide, aluminum oxide, and the like.

The top coat composition of a magnetic medium generally includes magnetic particles dispersed in a solvent. Examples of magnetic particles include iron oxide, cobalt doped iron oxide, chromium dioxide, aluminum oxide, dichromium trioxide, barrium ferrite, and similar materials. Typical solvents include methyl ethyl ketone, toluene, cyclohexanone, and tetrahydrofuran, any or all of which may serve as the compatible solvent. The top coat composition may also include lubricants such as fatty acids or esters of fatty acids. As desired, the aforementioned solvents and/or lubricants may also be used in the undercoating.

FIG. 1 schematically illustrates a preferred process and coating apparatus for producing a multilayered photographic element in accordance with the method of the present invention. As will be apparent to those skilled in the appropriate arts, however, other configurations may also be employed without deviating from the scope of the present invention. Support 10, in the form of a moving web, is fed from spool 12 and brought into contact with spacer roll 14. From spacer roll 14, the web travels around backing roll 16. At this point, undercoating 18 is applied to support 10 by slide coater 20. Undercoating 18 includes gelatin-based sublayers 22, 24, and 26 which emanate from slots 28, 30, and 32, respectively, in slide coater 20. Sublayers 22, 24, and 26 flow by force of gravity down the inclined surface 34 of slide coater 20 and onto support 10 to simultaneously form the three sublayers which make up undercoating 18. Thus, sublayer 26 becomes the bottom sublayer, sublayer 24 the middle sublayer, and sublayer 22 the uppermost sublayer of undercoating 18. This type of simultaneous application of multiple sublayers is illustrated in, e.g., U.S. Pat. No. 4,001,024.

Following the application of undercoating 18 to support 10, the moving web travels into chiller 36 and then into dryer 38. Chiller 36 causes the galatin-based sublayers 22–26 to gel or solidify. In this manner, the sublayers are prevented from intermixing during the drying thereof in dryer 38. After the moving web exits dryer 38, it travels around spacer rolls 40 and 42 before contacting tandem coating station 44. Top coat composition 46 is applied to the surface of undercoating 18 at tandem coating device 44 in such a manner that the ratio T/B is less than or equal to 3. From that point, top coat composition 46 is dried (i.e. the solvent is removed) in dryer 48 before the completed multilayered element 50 passes over spacer roll 52 and is gathered by spool 54.

Preferably, undercoating 18 is substantially dried in dryer 38. Stated more precisely, it is preferred that the binder in undercoating 18 be substantially dry before the top coat composition 46 is applied to undercoating 18. Undercoating 18 is typically accompanied by a compatible solvent when it is applied to support 10. This solvent acts as a carrier fluid. In addition to ensuring that the ratio T/B is less than or equal to 3, it is believed that substantially drying the binder further reduces the likelihood of excessive swelling thereof when it is contacted by the solvent in the top coat composition.

The phrase "substantially dry" is intended to mean that all but residual solvent is removed from the binder when it is dried. Residual solvent is that solvent which is chemically or physically bound to the binder or is otherwise not removable by drying under ambient conditions. In other words, when substantially dry, the solvent content of the binder tends to be in a nearly steady state equilibrium with the environment at ambient temperature, pressure, and humidity.

For example, when gelatin is used as the binder in the undercoating, water is normally used as the solvent-/carrier fluid for the undercoating. Depending upon the particular type of gelatin used, undercoating 18 is dried in dryer 38 for a period of about 1.5 to 9 minutes, at a temperature of about 60°–130° F. Residual water typically amounts to between 5% and 20% water, by weight, in substantially dried gelatin, again depending upon the particular type of gelatin which is used.

Advantageously, top coat composition 46 is applied in a tandem process. The word "tandem" is defined to mean an in-line coating station located in the same continuous process stream as the coating station in which the undercoating is applied. As illustrated in FIG. 1, tandem coating device 44 is located in the same coating apparatus (process stream) as slide coater 20. Thus, support 10 with undercoating 18 thereon does not have to be removed from the coating apparatus to allow undercoating 18 to harden, as had heretofore been required. Rather, both undercoating 18 and top coat composition 46 are applied in the same continuous operation with no idle hardening periods.

The application of top coat composition 46 can be carried out by standard coating techniques such as bar coating, roll coating, knife coating, etc. However, for most applications, it has been found that the above-stated ratio can most conveniently be achieved when top coat composition 46 is applied at a wet film thickness of 0.5 to 10 microns. Thus, tandem coating device 48 is preferably one which is capable of applying coatings of such thicknesses. An example of a suitable tandem coating device is a Yasui-Seiki micro-gravure coater as disclosed in U.S. Pat. No. 4,791,881. Particularly preferred is to operate such gravure coating devices in the "reverse-kiss" mode.

In order that the invention may be more readily understood, reference is made to the following examples, which are intended to be illustrative of the invention, but are not intended to be limiting in scope. Examples 1 and 2 illustrate a diffusion transfer top coat, Examples 3 and 4 illustrate a matte surface top coat, and Examples 5 and 6 illustrate an antistatic top coat.

Top coats for the examples were applied using a Yasui-Seiki microgravure coating apparatus as described in U.S. Pat. No. 4,791,881 with a variety of microgravure bars. The microgravure bars differed by their engraved patterns which provides a degree of control over the coating weight applied. The following bars were used with the Yasui-Seiki coating apparatus:

1) A 230 lpi (lines per inch), helically engraved gravure roll from the Yasui-Seiki Co.;
2) A 200 lpi, helically engraved gravure roll from the Yasui-Seiki Co.;
3) A 180 lpi, helically engraved gravure roll from the Yasui-Seiki Co.;
4) A 440 cpi (cells per inch), quad pattern, laser engraved Ucralox gravure roll from Prax Air Surface Tech, Inc.;
5) A 200 lpi, helical pattern, laser engraved Ucralox gravure roll from Prax Air Surface Tech, Inc..

EXAMPLE 1

Antihalation and silver halide photographic emulsion coating solutions were prepared as sublayers for the undercoating of a direct acting diffusion transfer plate. The antihalation and emulsion coatings were of the type normally used in such applications and were prepared in accordance with the examples set forth in U.S. Pat. No. 4,361,635, the disclosure of which is fully incorporated herein.

A series of preliminary solutions, similar to those described in Example 1 of U.S. Pat. No. 4,361,635, were prepared as follows:

(1) Palladium chloride solution: A solution of 1.0 g of $PdCl_2$ with 2.0 g of nitric acid diluted to 1 liter with water.
(2) Daxad ® 11 solution: A 10% aqueous solution by weight was prepared of Daxad ® 11 (a commercial dispersant from W. R. Grace Company).
(3) Triton ® X-100 solution: A 10% aqueous solution by weight was prepared of Triton ® X-100 (a wetting agent commercially available from Rohm & Haas Company).
(4) Dialdehyde starch solution: A 4.0% aqueous solution by weight was prepared from Sum Star ® 190 (dialdehyde starch (available from Hexel Chemical Company) including 10 g/liter of sodium acetate by heating to 80° C. under nitrogen for 1 hour.

(5) Potassium borohydride solution: A solution containing 2.0 g/l of potassium borohydride was prepared in water.

(6) FC-170C: A 0.2% aqueous solution by weight was prepared of FC-170C (a fluorochemical surfactant available from 3M Company).

A series of 5 top coat composition samples were prepared by combining the above preliminary solutions as set forth in Table 1 (all values are expressed as parts by weight):

TABLE 1

| Top coat | Solution | | | | | | |
|---|---|---|---|---|---|---|---|
| comp. | (1) | (2) | (3) | (4) | (5) | (6) | $H_2O$ |
| 1 | 149 | 91 | 16 | 517 | 136 | 91 | 0 |
| 2 | 75 | 45 | 16 | 487 | 68 | 91 | 218 |
| 3 | 53 | 32 | 16 | 341 | 48 | 91 | 419 |
| 4 | 37 | 22 | 16 | 242 | 34 | 91 | 558 |
| 5 | 23 | 14 | 16 | 146 | 20 | 91 | 690 |

A series of coatings were carried out consisting of the antihalation and emulsion layers as the undercoating and overcoated with the top coat compositions described above. The antihalation layer was coated on a subbed polyester film support in a conventional manner using the standard slide coating methodology to provide a layer with a gelatin coating weight of 2.7 g/m$^2$. The photographic emulsion was a chlorobromide emulsion and was likewise coated over the antihalation layer to provide a sublayer containing 0.7 grams silver per meter$^2$ and gelatin binder at 1.4 g/m$^2$. The total coating weight of gelatin in the undercoating was approximately 4 g/m$^2$.

Top coat compositions 1, 2, 3, 4, and 5 were applied to the undercoating at coating weights of 3, 4.5, 6, 12, and 20 g/m$^2$, respectively, so that the resulting multilayered elements would have approximately the same surface coverage of palladium after the coating of the top coat composition. Top coat compositions 1, 2, and 3 were applied in a tandem manner, after the undercoating was substantially dried, using the micro-gravure coating device disclosed in U.S. Pat. No. 4,791,881 (commercially available from the Yasui Seiki Co, Ltd., Tokyo, Japan). These top coat compositions were applied using the 230, 200, and 180 lpi Yasui-Seiki helical gravure rolls, respectively. All of these gravure tolls were operated at gravure roll surface speed to web speed ratios of 1.25. Top coat compositions 4 and 5 were applied via a conventional slide coater in a 2 pass operation, where the first coating was quickly dried and wound up and then immediately processed through the coater again so that the top coat composition could be applied to the undercoating.

The water content of the top coat compositions were over 95% and, ignoring the non-aqueous portion, provided T/B ratios from 0.75 to 3.00 as noted in Table 2.

TABLE 2

| Sample | Top coat Coat'g Wt. (g/m$^2$) | Gelatin Coat'g Wt. (g/m$^2$) | Ratio T/B | Rollup Number | MPID |
|---|---|---|---|---|---|
| 1 | 3 | 4 | 0.75 | 15 | — |
| 2 | 4.5 | 4 | 1.13 | 250 | 0.99 |
| 3 | 6 | 4 | 1.50 | 250 | 0.80 |
| 4 | 12 | 4 | 3.00 | 250 | 0.08 |
| 5 | 20 | 4 | 5.00 | 250 | 0.08 |

After drying, printing plates were prepared by exposing the multilayered elements through a photographic positive and processing the resultant structure in Onyx® Pre-Mix Developer and Onyx® Stabilizer Concentrate, both of which are commercially available from the 3M Company. The printing plates were tested on a Heidelburg GTO printing press, commercially available from the Heidelburg Company. The ink utilized in conjunction with this press was a 3-3109 Magnetic Black Soya Ink, commercially available from the A. B. Dick Co.

The performance of the exposed and developed multilayered element as a functional printing plate is measured by two characteristics: the Rollup Number and the Maximum Printed Ink Density (MPID). The primary criterion is the rollup number, which is the number of impressions required on a printing press to achieve a good quality copy. Lower numbers are indicative of better performance. It should be noted that after 25 sheets, the impression quality is limitedly checked at 100 then between 200 and 250 counts. In the absence of good performance in the rollup test, characterized by a number less than 25, the MPID is a second test which characterizes the performance of these materials. This is a measure of the maximum printed ink density that the plate transfers to the paper. In this case, higher numbers indicate better performance. Values under 0.8 are unacceptable and indicate a lack of performance as a printing plate. Both the rollup and MPID values are the average of at least two evaluations.

As can be seen from Table 2, very good functional performance was achieved when the T/B ratio was 0.75. For higher ratios, MPID provides discrimination showing the deterioration in performance as the ratio increases.

EXAMPLE 2

Antihalation and silver halide photographic emulsion coating solutions were prepared for the undercoating of a direct acting diffusion transfer plate as in Example 1. The coating weights of the antihalation and emulsion layers were modified to provide total gelatin coating weights of 2, 4 and 6 g/m$^2$ in the undercoating. The undercoating was prepared such that for every g/m$^2$ of gelatin in the emulsion layer, 2 g/m$^2$ of gelatin was present in the antihalation layer. For example, in the samples containing a total of 2 g/m$^2$ gelatin in the undercoating, 0.67 g/m$^2$ of gelatin was present in the emulsion layer while 1.33 g/m$^2$ of gelatin was present in the antihalation layer. These were coated with palladium-containing top coat compositions to provide water coating weights in the top coat composition of 1.3, 3, 4.5, 6 and 8 g/m$^2$ (again ignoring the solids content of these compositions).

The top coat compositions were similar to those used in Example 1, and were likewise formulated so that the resulting multilayered elements would have approximately the same surface content of palladium after the coating of the top coat composition. The 1.3, 3, 4.5, 6, and 8 g/m$^2$ top coat compositions shown in Table 3 were obtained using the 440 cpi Prax Air Quad, the 230 lpi Yasui-Seiki helical, the 200 lpi Yasui-Seiki helical, the 180 lpi Yasui-Seiki helical, and the 200 lpi Prax Air helical gravure rolls, respectively. The gravure rolls were operated at gravure roll surface speed to web speed ratios of 3, 1.25, 1.25, 1.25, and 0.5, respectively.

These samples were exposed and processed in the manner set forth in Example 1. The resultant printing plates were then evaluated, also in the manner set forth in Example 1. Table 3 gives the results of these evaluations.

TABLE 3

| Sample | Gelatin Coat'g Wt. ($g/m^2$) | Top coat Coat'g Wt. ($g/m^2$) | Ratio T/B | Rollup Number | MPID |
|---|---|---|---|---|---|
| 1 | 6 | 1.3 | 0.22 | 14 | — |
| 2 | 6 | 3.0 | 0.50 | 26 | — |
| 3 | 6 | 4.5 | 0.75 | 14 | — |
| 4 | 6 | 6.0 | 1.00 | 37 | — |
| 5 | 6 | 8.0 | 1.33 | 250 | 0.39 |
| 6 | 4 | 1.3 | 0.33 | 11 | — |
| 7 | 4 | 3.0 | 0.75 | 18 | — |
| 8 | 4 | 4.5 | 1.13 | 17 | — |
| 9 | 4 | 6.0 | 1.50 | 33 | — |
| 10 | 4 | 8.0 | 2.00 | 250 | 0.60 |
| 11 | 2 | 1.3 | 0.65 | 19 | — |
| 12 | 2 | 3.0 | 1.50 | 28 | — |
| 13 | 2 | 4.5 | 2.25 | 50 | — |
| 14 | 2 | 6.0 | 3.00 | 50,250 | 0.83 |
| 15 | 2 | 8.0 | 4.00 | 250 | 0.38 |

The results show that good rollup numbers are achieved with low ratios and that performance falls off as the ratio is increased. It can also be seen in samples 5 and 10 that, despite ratios which were not excessively high (1.33 and 2.00), performance is compromised by the high top coat loading (8 $g/m^2$). Additional testing with top coat loadings of 10, 15 and 20 $g/m^2$, giving T/B ratios $>3$, showed roll-ups greater than 250 and unacceptable values for MPID.

EXAMPLE 3

A series of photographic emulsion films of the graphic arts contact film type were prepared using a silver chlorobromide emulsion (84 mole % chloride, 16 mole % bromide). The emulsion undercoatings were prepared with silver coating weights of 1.25, 2.5 and 3.75 $g/m^2$ and gelatin coating weights of 0.85, 1.71, and 2.56 $g/m^2$, respectively. There was no hardener added to the emulsion undercoatings. Rather, hardener (in the form of formaldehyde) was later added to the emulsion at the tandem coating station as a component of the top coat composition to demonstrate that hardening of the undercoating before application of the top coat composition is not required in order to maintain the top coat at the surface of the multilayered element.

Top coats were prepared by adding gelatin to cold water, adding a wetting agent premix, and allowing the resultant mixture to soak for at least 20 minutes. The wetting agent premix was prepared by dissolving 11.5 g of Maprofix® 563 (sodium lauryl sulfonate supplied by the Onyx Chemical Company) and 20 g of Ninol® 96-SL (an alkanol amide supplied by the Stepan Company) in water and making up to 1 liter. The gelatin/wetting agent mixture was then dissolved by warming to 40° C. with mixing.

PMMA beads, a matting agent comprising beads of polymerized polymethylmethacrylate, were then added. The PMMA beads were about 4$\mu$ in size and were present as a dispersion in water containing 5% solids. A hardening agent (a formaldehyde solution containing 37% formaldehyde and 63% water) was added immediately before coating.

Top coat compositions were prepared according to Table 4. The formulations result in 1 kg of each top coat. The formulations were prepared so as to basically maintain a constant ratio between the PMMA and gelatin in the undercoating, and also between the formaldehyde and gelatin in the undercoating.

TABLE 4

| Top coat composition | Gelatin | PMMA | Wetting Agent | Formaldehyde | Water |
|---|---|---|---|---|---|
| 1 | 57 | 240 | 35 | 71 | 597 |
| 2 | 38 | 160 | 35 | 47 | 720 |
| 3 | 29 | 120 | 35 | 39 | 778 |
| 4 | 17 | 72 | 35 | 21 | 855 |

The emulsion undercoating was applied to a moving web support using traditional slide coating methodology, and then chilled in a chiller having a dry bulb temperature of 40° F. and a dew point of 18° F. The moving web had a 0.3 minute residence time in the chiller. The emulsion undercoating then traveled through three drying zones having dry bulb temperatures of 87° F., 100° F., and 123° F., respectively, and dew points of 31° F., 52° F., and 52° F., respectively. The residence time in each drying zone was 1.3 minutes.

Following the chilling and drying of the undercoating, a top coat solution was coated at a tandem coating station using the aforementioned Yasui-Seiki microgravure coating apparatus. Top coat compositions 1–4 were applied at coating weights of 3, 4.5, 6, and 10 $g/m^2$, respectively, using the 230 lpi Yasui-Seiki helical, the 200 lpi Yasui-Seiki helical, the 180 lpi Yasui-Seiki helical, and the 200 lpi Prax Air helical gravure rolls, respectively, at gravure roll surface speed to web speed ratios of 1.25, 1.25, 1.25, and 0.5, respectively. The resultant top coats had PMMA coverage in the range of 0.7 to 0.8 $g/m^2$, gelatin coverage in the range of 0.17 to 0.20 $g/m^2$, and formaldehyde coverage in the range of 0.08 to 0.09 $g/m^2$. Since the various top coat compositions comprised approximately 95% water, the solids content of the top coat compositions were ignored for purposes of calculating the T/B ratios shown in Table 5.

The coated samples were fully exposed (white light exposure to give the maximum density) and then processed in the normal manner. The samples were evaluated based on the degree of "starry night" which was exhibited. This determination was conducted by an automated apparatus which counts the number of "stars" (i.e. voids in the image) per unit area. The voids in the image were caused by PMMA beads which were forced into the undercoating from the top coat during drying, thereby displacing silver halide particles in the undercoating. Preferred performance is for a low number of stars, most preferably zero.

The results of the sample evaluations are given in Table 5. Star counts are the average of at least two independent measurements on separate samples.

TABLE 5

| Sample | Ag $g/m^2$ | Undercoating [Gel $g/m^2$] | Top coat [$H_2O$ $g/m^2$] | T/B Ratio | Star Count |
|---|---|---|---|---|---|
| 1 | 3.75 | 2.56 | 3 | 1.17 | 0 |
| 2 | 3.75 | 2.56 | 4.5 | 1.76 | 2 |
| 3 | 2.5 | 1.71 | 3 | 1.76 | 67 |
| 4 | 3.75 | 2.56 | 6 | 2.34 | 7 |
| 5 | 2.5 | 1.71 | 4.5 | 2.64 | 247 |
| 6 | 2.5 | 1.71 | 6 | 3.51 | 499 |
| 7 | 3.75 | 2.56 | 10 | 3.90 | 63 |
| 8 | 1.25 | 0.85 | 3 | 3.51 | 239 |
| 9 | 2.5 | 1.71 | 10 | 5.86 | 557 |
| 10 | 1.25 | 0.85 | 4.5 | 5.27 | 463 |
| 11 | 1.25 | 0.85 | 6 | 7.03 | 587 |
| 12 | 1.25 | 0.85 | 10 | 11.71 | 1,130 |

A regression analysis shows excellent correlation of the star count to the T/B ratio with an adjusted correlation coefficient, $R^2$, equal to 88%:

$$\text{Star count} = -194 + 136 * [\text{T/B ratio}].$$

It is worthwhile to note that the regression analysis predicts that at a T/B ratio of about 1.4, the star count would fall to 0 eliminating the starry night effect.

It should be noted that the experiment was designed to provide approximately the same surface loading of the matting agent for the various samples. Thus, the surface roughnesses of the samples were similar.

EXAMPLE 4

A series of photographic emulsion films of the graphic arts camera film type were prepared using a silver iodochlorobromide emulsion (2 mole % iodide, 20 mole % chloride and 78 mole % bromide). The photographic emulsion and a protective layer were coated as sublayers in the undercoating using a conventional two slot slide coating technique. The photographic emulsion was coated to provide a layer with a silver coating weight of 3.2 g/m$^2$ and a gelatin coating weight of 3.11 g/m$^2$. The protective layer was coated on the emulsion and included a gelatin coating weight of 0.74 g/m$^2$. This gave a total gelatin coating weight in the undercoating of 3.85 g/m$^2$. Triazine hardener was added to the undercoating at a coating weight of 0.581 g/m$^2$.

5 top coat compositions were produced by combining the following preliminary solutions with deionized water:

(1) Gelatin: a 10% aqueous gelatin solution;
(2) Hostapur ® SAS-93: a 10.8% aqueous solution of an aliphatic sulfonate mixture (a surfactant commercially available from the American Hoechst Company);
(3) Triazine: a hardening agent comprising a 10% aqueous solution of 2,4-dichloro-6-hydroxy-5-triazine;
(4) Gasil ®-23F: an aqueous solution containing 2.5% silica and 8% gelatin (a matting agent commercially available from the Crosfield Company);
(5) Slip-Ayd ® SL-530: a solution of 18% polyethylene in 2-butoxyethanol (a friction reducing agent commercially available from the Daniel Products Company).

The 5 top coat compositions were prepared by combining the above preliminary solutions as set forth in Table 6 (all values being expressed as parts by weight):

TABLE 6

| Top coat composition | Solution (1) | Solution (2) | Solution (3) | Solution (4) | Solution (5) | $H_2O$ |
|---|---|---|---|---|---|---|
| 1 | 383 | 18.1 | 50 | 146 | 0 | 403 |
| 2 | 192 | 18.1 | 25 | 73 | 0 | 692 |
| 3 | 256 | 18.1 | 33.3 | 97 | 9.6 | 586 |
| 4 | 383 | 18.1 | 50 | 146 | 28.8 | 374 |
| 5 | 192 | 18.1 | 25 | 73 | 14.4 | 678 |

Following the chilling and drying of the undercoating as described above in Example 3, a top coat composition was coated onto the undercoating at a tandem coating station using the aforementioned Yasui-Seiki microgravure coating apparatus. Combinations of the top coat compositions listed in Table 6 served to produce the same composition of solids in the top coat for all of the samples shown in Table 7. Top coat composition coating weights of 2.5, 3.75 and 5.0 g/m$^2$ were applied at gravure roll surface speed to web speed ratios of 1.25 using the 230 lpi Yasui-Seiki helical, the 200 lpi Yasui-Seiki helical, and the 180 lpi Yasui-Seiki helical gravure rolls, respectively. The resultant top coats had a gelatin coating weight of 0.125 g/m$^2$ and a slica coating weight of 0.0091 g/m$^2$. Since the various top coat compositions comprised approximately 95% water, the solids content of the top coat compositions were ignored for purposes of calculating the T/B ratios, as shown in Table 7.

The resulting samples were exposed, processed and evaluated for starry night. Star counts are the average of at least two independent measurements on separate samples. The results are given in Table 7.

TABLE 7

| Case | Ag g/m$^2$ | Undercoat [Gel g/m$^2$] | Top coat [$H_2O$ g/m$^2$] | T/B Ratio | Slip-Ayd ® | Star Count |
|---|---|---|---|---|---|---|
| 1 | 3.2 | 3.85 | 2.5 | 0.65 | 0 | 1.5 |
| 2 | 3.2 | 3.85 | 5.0 | 1.30 | 0 | 20.0 |
| 3 | 3.2 | 3.85 | 3.75 | 0.97 | 0.036 | 3.4 |
| 4 | 3.2 | 3.85 | 2.5 | 0.65 | 0.072 | 4.8 |
| 5 | 3.2 | 3.85 | 5.0 | 1.30 | 0.072 | 52.0 |
| 6 | 3.2 | 3.85 | 73 | 19.0 | 0 | 210.5 |

A control (case 6) was included and consisted of traditional methodology in which the protective layer of the undercoating contains the matting agent and was coated along with the emulsion using a slide coater in conventional two slot manner. The same matting agent (Gasil ® -23F silica) was used in case 6 to provide essentially the same surface coverage of silica as in cases 1–5.

It is apparent that 'Starry Night' is minimized as the T/B ratio decreases. It is also seen that the addition of Slip-Ayd ® can influence the degree of starry night, but does not alter the basic response of starry night with respect to the T/B ratio. It is also apparent that the trials coated in conformance with the teachings of this patent have a starry night very significantly lower than that obtained in the normal practice of the art (case 6).

EXAMPLE 5

The evaluation of antistatic properties of a material is measured by the surface resistivity which is the inverse of conductivity. The lower the surface resistivity (or the higher the conductivity), the better is the performance as an antistatic layer. Surface resistivities are measured in units of ohms per square. For basically non-conductive polymer films (including gelatin), the surface conductivities are typically above $10^{11}$ ohms per square and usually above $10^{13}$ ohms per square. Materials with good conductivity for antistatic performance have resistivities under $10^{11}$ ohms per square (100 gigaohms per square) and more preferably under $10^{10}$ ohms per square (10 gigaohms per square). The measurements in the examples will be simply expressed as gigaohms. Materials with resistivities under 10 gigaohms would be characterized as exhibiting good antistatic performance, while those with resistivities over 100 gigaohms would be characterized as poor in antistatic performance. Materials with surface resistivities of between 10 and 100 gigaohms would be considered to have adequate antistatic performance.

A sample of conventional medical X-ray material was used with an undercoating consisting of an emulsion layer having a silver coating weight of 4.2 g/m$^2$ and a gelatin coating weight of 2.50 g/m$^2$, and a protective gelatin layer having a gelatin coating weight of 1.01 g/m$^2$. The total gelatin coating weight in the undercoating (B) was 3.51 g/m$^2$.

Samples were top coated with differing antistatic layers and compared with non-top coated material. Top coat compositions were prepared from Tergitol® 15-S-7 (an antistatic material commercially available from Union Carbide) containing the material at levels of 0.4% and 1.0% by weight in water. The samples were top coated with a Meyer bar coater to a top coat coating weight of 26 g/m$^2$. Since over 99% by weight of the top coat composition was water, the T/B ratio was calculated using 26 g/m$^2$ as T, resulting in a T/B ratio of 7.41 for both of the top coated samples in Table 8.

The antistatic coverages were determined to be 100 and 260 mg/m$^2$ calculated from the solution concentration and the wet coverage. The top coated samples were then stored for 24 hours in an environmental chamber at 20° C. and at 25% relative humidity. The surface resistivities of the samples were measured using a 610C Electrometer, a conductivity tester commercially available from Keithley Instruments. The results are set forth in Table 8.

TABLE 8

| | Antistatic Coverage (mg/m$^2$) | T/B Ratio | Resistivity (gigaohm per sq.) |
|---|---|---|---|
| Non-topcoated material | — | — | 50,000 |
| 0.4% solution | 100 | 7.41 | 10,000 |
| 1.0% solution | 260 | 7.41 | 100 |

The untreated X-ray film had a surface resistivity of approximately 50,000 gigaohms. At antistatic coverages of 100 mg/m$^2$ applied at a T/B ratio of 7.41 there is very little functionality. To achieve adequate antistatic performance a coverage of 260 mg/m$^2$ was required. The T/B ratio of 7.41 resulting from a wet top coat coating weight of 26 g/m$^2$ onto a subcoating of 3.51 g/m$^2$ is typical of a conventional processes. Thus, in spite of excessive top coat coating weights (high T/B ratio), a degree of antistatic performance could be achieved by applying a very high coverage of the antistatic material.

EXAMPLE 6

A sample of conventional medical X-ray material, having a total gelatin coating weight (B) of 3.51 g/m$^2$, was used as in Example 5. This material was then top coated with a series of top coat compositions to apply the antistatic layer with varying water and material coating weights. Aqueous top coat compositions having antistatic concentrations of Tergitol® 15-S-7 (Union Carbide) ranging from 0.72% to 1.28% were prepared. The top coat compositions were each coated using the Yasui-Seiki micro-gravure coating apparatus. Coating weights of the top coat compositions ranged from 2.4 to 6.5 g/m$^2$, resulting in T/B ratios ranging from 0.68 to 1.85 (the small amounts of Tergitol® in the top coat compositions were ignored in calculating the T/B ratio).

The top coated samples were then stored for 24 hours in an environmental chamber at 20° C. and at 25% relative humidity. The surface resistivities of the samples were measured using a 610C Electrometer (Keithley Instruments). The resistivities are reported in Table 9 as gigaohms.

A regression analysis of the data set forth in Table 9 shows good correlation between the antistatic coverage (mg/m$^2$) and the T/B ratio vs. the resistivity, with an adjusted correlation coefficient ($R^2$) equal to 60%.

$$\text{Resistivity} = 9.53 + 2.28 * (T/B) - 0.182 * (\text{antistatic coverage})$$

Antistatic coverage, the importance of which was noted in Example 5, is the dominant variable and is responsible for 75% of the explained data variation in resistivity. The T/B ratio explains the remainder of the data variation.

It is worthwhile to note the prediction of the above regression analysis model. The coefficient for the T/B ratio is positive in the regression equation, and thus indicates that poorer antistatic properties (higher surface resistivities) result as the T/B ratio increases. Assuming a desire to be below 10 gigaohms resistivity, in the domain of good antistatic performance, a minimum surface coverage of about 35 mg/m$^2$ is required. Most of the data points are above the 35 mg/m$^2$ level and it is apparent that they all have low surface resistivities (good antistatic performance). The limited data points below the 35 mg/m$^2$ surface coverage show markedly poorer antistatic protection. Thus, using the 35 mg/m$^2$ level as the minimum acceptable surface coverage, the model predicts surface resistivities of 10.0, 7.72, and 5.73 gigaohms for ratios of 3, 2, and 1,125, respectively.

The difference in antistatic performance between the samples from Example 5 and Example 6 demonstrate the advantage of the practice of the present invention. As compared to the samples in Example 6, the samples from Example 5 (which were coated in a conventional manner) required much more surface coverage, 260 mg/m$^2$, to achieve only minimally acceptable antistatic performance of 100 gigaohms (as compared to the superior resistivities of 10 gigohms and below of Example 6, as shown in Table 9). The difference in antistatic performance between the samples of Example 5 and those of Example 6 is believed due to the fact that the bulk of the antistatic material in the conventionally applied top coat composition of the Example 5 samples is absorbed into the undercoating. Only with very high coverages is there adequate material on the surface to provide antistatic performance.

On the other hand, the samples from Example 6, coated in accordance with the method of the present invention, required much less surface coverage, 35 mg/m$^2$, and resulted in better antistatic performance (less than 10 gigaohms) than than that exhibited by the samples in Example 5. Thus, coating in conformance with the teachings of this invention results in more of the material remaining on the surface to provide good antistatic performance.

If the antistatic coverage is allowed to increase above the minimally required 35 mg/m$^2$ to approximately 70 mg/m$^2$, and the T/B ratio is maintained at 3 or below, resistivities of 3.63 gigaohms or less are predicted and, in fact, achieved as noted in samples 6–8 from Table 9. This is in sharp contrast to the 100 mg/m$^2$ sample in Example 5, where a T/B ratio of 7.41 led to a surface resistivity of 10,000 gigaohms.

It is thus apparent that for a given level of antistatic coverage, the T/B ratio is the controlling parameter. Further, by coating in accordance with the method of the present invention, good antistatic performance can be achieved with low to moderate coverage levels of antistatic material.

TABLE 9

| SAMPLE | ANTI-STATIC CONCENTRATION (g/l) | ANTI-STATIC COVERAGE (mg/m²) | GEL LOADING (g/m²) | TO-COAT LOADING (g/m²) | T/B RATIO | RESISTIVITIES (gigaohm) |
|---|---|---|---|---|---|---|
| 1 | 8.00 | 52.0 | 3.51 | 6.50 | 1.85 | 3.38 |
| 2 | 8.00 | 48.8 | 3.51 | 6.10 | 1.74 | 4.86 |
| 3 | 8.00 | 45.6 | 3.51 | 5.70 | 1.62 | 3.81 |
| 4 | 8.00 | 52.0 | 3.51 | 6.50 | 1.85 | 4.11 |
| 5 | 12.00 | 63.6 | 3.51 | 5.30 | 1.51 | 1.91 |
| 6 | 12.00 | 73.2 | 3.51 | 6.10 | 1.74 | 2.05 |
| 7 | 12.00 | 68.4 | 3.51 | 5.70 | 1.62 | 1.79 |
| 8 | 12.00 | 73.2 | 3.51 | 6.10 | 1.74 | 1.91 |
| 9 | 10.00 | 53.0 | 3.51 | 5.30 | 1.51 | 2.23 |
| 10 | 10.00 | 57.0 | 3.51 | 5.70 | 1.62 | 2.43 |
| 11 | 10.00 | 57.0 | 3.51 | 5.70 | 1.62 | 2.43 |
| 12 | 10.00 | 61.0 | 3.51 | 6.10 | 1.74 | 2.67 |
| 13 | 7.20 | 43.9 | 3.51 | 6.10 | 1.74 | 9.54 |
| 14 | 12.80 | 67.8 | 3.51 | 5.30 | 1.51 | 1.91 |
| 15 | 10.00 | 65.0 | 3.51 | 6.50 | 1.85 | 2.32 |
| 16 | 10.00 | 61.0 | 3.51 | 6.10 | 1.74 | 2.14 |
| 17 | 8.00 | 45.6 | 3.51 | 5.70 | 1.62 | 4.11 |
| 18 | 8.00 | 48.8 | 3.51 | 6.10 | 1.74 | 5.56 |
| 19 | 8.00 | 36.0 | 3.51 | 4.50 | 1.28 | 4.45 |
| 20 | 8.00 | 42.4 | 3.51 | 5.30 | 1.51 | 4.45 |
| 21 | 12.00 | 43.2 | 3.51 | 3.60 | 1.03 | 1.94 |
| 22 | 12.00 | 58.8 | 3.51 | 4.90 | 1.40 | 2.05 |
| 23 | 12.00 | 49.2 | 3.51 | 4.10 | 1.17 | 1.78 |
| 24 | 12.00 | 54.0 | 3.51 | 4.50 | 1.28 | 2.05 |
| 25 | 10.00 | 41.0 | 3.51 | 4.10 | 1.17 | 2.32 |
| 26 | 10.00 | 49.0 | 3.51 | 4.90 | 1.40 | 2.67 |
| 27 | 10.00 | 49.0 | 3.51 | 4.90 | 1.40 | 2.43 |
| 28 | 10.00 | 49.0 | 3.51 | 4.90 | 1.40 | 2.72 |
| 29 | 7.20 | 32.4 | 3.51 | 4.50 | 1.28 | 5.04 |
| 30 | 12.80 | 62.7 | 3.51 | 4.90 | 1.40 | 2.14 |
| 31 | 10.00 | 49.0 | 3.51 | 4.90 | 1.40 | 2.23 |
| 32 | 10.00 | 53.0 | 3.51 | 5.30 | 1.51 | 2.54 |
| 32 | 10.00 | 53.0 | 3.51 | 5.30 | 1.51 | 2.54 |
| 33 | 8.00 | 22.4 | 3.51 | 2.80 | 0.80 | 7.22 |
| 34 | 8.00 | 25.6 | 3.51 | 3.20 | 0.91 | 10.70 |
| 35 | 8.00 | 22.4 | 3.51 | 2.80 | 0.80 | 8.34 |
| 36 | 12.00 | 43.2 | 3.51 | 3.60 | 1.03 | 4.11 |
| 37 | 12.00 | 43.2 | 3.51 | 3.60 | 1.03 | 3.76 |
| 38 | 12.00 | 40.8 | 3.51 | 3.40 | 0.97 | 3.56 |
| 30 | 12.00 | 38.4 | 3.51 | 3.20 | 0.91 | 7.97 |
| 40 | 10.00 | 36.0 | 3.51 | 3.60 | 1.03 | 4.21 |
| 41 | 10.00 | 36.0 | 3.51 | 3.60 | 1.03 | 7.03 |
| 42 | 10.00 | 32.0 | 3.51 | 3.20 | 0.91 | 4.73 |
| 43 | 10.00 | 34.0 | 3.51 | 3.40 | 0.97 | 6.68 |
| 44 | 7.20 | 20.2 | 3.51 | 2.80 | 0.80 | 10.70 |
| 45 | 12.80 | 30.7 | 3.51 | 2.40 | 0.68 | 3.47 |
| 46 | 10.00 | 32.0 | 3.51 | 3.20 | 0.91 | 6.21 |
| 47 | 10.00 | 32.0 | 3.51 | 3.20 | 0.91 | 5.45 |

What is claimed is:

1. A method for producing a multilayered element having a top coat, comprising the steps of:

a. providing a support having an upper surface and a lower surface;

b. applying an undercoating to said upper surface, said undercoating including a binder;

c. applying a top coat composition to the surface of said undercoating to form a continuous top coat, said top coat composition including one or more dispersed materials and one or more solvents, at least one of said one or more solvents being compatible with said binder, the composition and coating weight of said top coat composition and of said undercoating being such that the ratio T/B is less than or equal to 3, wherein T is the coating weight of said at least one compatible solvent, and B is the coating weight of said binder; and d. drying said top coat composition, whereby, at least one third by weight of said dispersed materials remain on the surface of said undercoating to form said top coat.

2. The method of claim 1 wherein said ratio is less than or equal to 2.

3. The method of claim 2 wherein said ratio is less than or equal to 1.125.

4. The method of claim 1 wherein said top coat composition is applied at a wet film thickness of 0.5 to 10 microns.

5. The method of claim 1 wherein said binder is applied at a coating weight of 1.25 to 4.5 grams/m².

6. The method of claim 1 wherein said dispersed material comprises a nucleating agent selected from the group consisting of metals, metal salts, metal oxides, metal sulfides, metal coated particles, metal salt coated particles, metal oxide coated particles, or metal sulfide coated particles.

7. The method of claim 6 wherein said binder comprises gelatin and said solvent comprises water.

8. The method of claim 7 further including the step of substantially drying said gelatin prior to applying said top coat composition to said underlayer.

9. The method of claim 7 wherein said undercoating comprises one or more sublayers, including a negative acting silver halide diffusion transfer emulsion.

10. The method of claim 6 wherein said nucleating agent comprises palladium or palladium salts.

11. The method of claim 1 wherein said dispersed material comprises a dispersed particulate matte agent.

12. The method of claim 11 wherein said binder comprises gelatin and said solvent comprises water.

13. The method of claim 12 further including the step of substantially drying said gelatin prior to applying said top coat composition to said underlayer.

14. The method of claim 13 wherein said multilayered element is photographic film, and wherein said undercoating comprises one or more sublayers, including a silver halide emulsion.

15. The method of claim 1 wherein said top coat composition is applied in a tandem process.

16. The method of claim 15 wherein said top coat composition is applied with a gravure coating device.

17. A method for producing a multilayered element having a top coat, comprising the steps of:

a. providing a support having an upper surface and a lower surface;

b. applying an undercoating to said upper surface, said undercoating including a binder;

c. applying a top coat composition to the surface of said undercoating to form a continuous top coat, said top coat composition including a dissolved antistatic material and one or more solvents, at least one of said one or more solvents being compatible with said binder, the composition and coating weight of said top coat composition and of said undercoating being such that the ratio T/B is less than or equal to 3, wherein T is the coating weight of said at least one compatible solvent, and B is the coating weight of said binder; and d. drying said top coat composition, whereby at least a continuous monolayer of said antistatic material remains on the surface of said undercoating to form said top coat.

18. The method of claim 17 wherein said ratio is less than or equal to 2.

19. The method of claim 18 wherein said ratio is less than or equal to 1.125.

20. The method of claim 17 wherein said top coat composition is applied at a wet film thickness of 0.5 to 10 microns.

21. The method of claim 20 wherein said binder comprises gelatin and said solvent comprises water.

22. The method of claim 21 further including the step of substantially drying said gelatin prior to applying said top coat composition to said underlayer.

23. The method of claim 22 wherein said multilayered element is photographic film, and wherein said undercoating comprises one or more sublayers, including a silver halide emulsion.

24. The method of claim 17 wherein said top coat composition is applied in a tandem process.

25. The method of claim 24 wherein said top coat composition is applied with a gravure coating device.

* * * * *

UNITED STATES PATENT AND TRADEMARK OFFICE

CERTIFICATE OF CORRECTION

PATENT NO. : 5,368,894

DATED : November 29, 1994

INVENTOR(S) : Lammers et al.

It is certified that error appears in the above-indentified patent and that said Letters Patent is hereby corrected as shown below:

Column 4, line 56, delete "1,125" and insert --1.125--.

Column 18, line 8, delete "slica" and insert --silica--.

Column 20, line 29, delete "1,125" and insert --1.125--.

Column 21, Table 9, fifth column, in the title, delete "TO-" and insert --TOP---.

Column 21, Table 9, Sample 7, seventh column, delete "1.79" and insert --1.78--.

Column 21, Table 9, Sample 21, seventh column, delete "1.94" and insert --1.84--.

Signed and Sealed this

Second Day of May, 1995

Bruce Lehman

*Attest:*

BRUCE LEHMAN

*Attesting Officer*

*Commissioner of Patents and Trademarks*